US006105516A

United States Patent [19]

Bowen

[11] Patent Number: 6,105,516

[45] Date of Patent: Aug. 22, 2000

[54] BURNER NOZZLE FOR PULVERIZED COAL

[76] Inventor: Peter Bowen, 1084 Lakeshore Road West, St. Catharines, Ontario, Canada, L2R 6P9

[21] Appl. No.: 09/004,653

[22] Filed: Jan. 8, 1998

[51] Int. Cl.[7] ..... F23C 1/10

[52] U.S. Cl. ..... 110/261; 110/263; 110/104 B; 239/590.5; 239/500; 239/502

[58] Field of Search ..... 110/260, 261, 110/263, 262, 104 B; 239/590, 590.5, 500, 502; 431/159, 354

[56] References Cited

U.S. PATENT DOCUMENTS

| | | | |
|---|---|---|---|
| 2,956,400 | 10/1960 | Ferri | 60/35.6 |
| 3,859,935 | 1/1975 | Walker | 110/22 A |
| 4,041,694 | 8/1977 | Lewis | 60/39.02 |
| 4,348,170 | 9/1982 | Vatsky et al. | 431/188 |
| 4,380,202 | 4/1983 | LaRue et al. | 110/263 |
| 4,408,548 | 10/1983 | Schmalfeld et al. | 110/347 |
| 4,479,442 | 10/1984 | Itse et al. | 110/261 |
| 4,634,054 | 1/1987 | Grusha | 239/423 |
| 5,483,906 | 1/1996 | Hufton | 110/260 |
| 5,593,302 | 1/1997 | Althaus et al. | 431/353 |
| 5,669,766 | 9/1997 | Hufton | 431/187 |

FOREIGN PATENT DOCUMENTS

| | | | |
|---|---|---|---|
| 275515 | 1/1990 | Germany | F23C 3/00 |
| 131808 | 5/1989 | Japan | F23D 14/64 |
| 917404 | 2/1963 | United Kingdom . | |

*Primary Examiner*—Ira S. Lazarus
*Assistant Examiner*—Ljiljana V. Ciric
*Attorney, Agent, or Firm*—Carothers & Carothers

[57] ABSTRACT

A stationary coal nozzle for a burner on a pulverized coal fired furnace having an elongated tubular nozzle with an inlet for receiving a flowing stream of coal/air mixture and an outlet for discharging the flowing stream into a combustion zone of a furnace for burning. A multiple of transversely extending rib segments protrude into the nozzle from its inside wall and are circumferentially arranged for distributing and diffusing a flowing stream of pulverized coal in the coal/air mixture upon exiting the nozzle outlet. A deflector plate may also be provided which closes off an upper portion of the nozzle inlet to prevent pulverized fuel roping.

18 Claims, 3 Drawing Sheets

BURNER NOZZLE FOR PULVERIZED COAL

BACKGROUND OF THE INVENTION

The present invention relates to a burner for pulverized coal and more particularly to a stationary coal nozzle for a burner on a pulverized coal fired furnace.

A wide variety of burner designs have been developed over the years for burners used in furnaces, boilers and the like for burning pulverized coal. Problems incurred in burning pulverized coal often can be associated with coal roping in the fuel delivery system. Fuel roping is believed to be caused by centrifugal flow patterns established by elbows and pipe bends.

Coal roping causes poor fuel distribution exiting the nozzle tip or outlet which results in flame variations. These flame variations range from substoichiometric fuel rich zones, where the reducing atmosphere contributes to slagging and water wall erosion, to high oxygen zones, which potentially create high thermal generation oxides of nitrogen. With these wide variations at each burner of a multiple burner unit, unit control is difficult.

In an attempt to reduce nitrogen oxide levels and to reduce fuel roping, many stationary coal nozzles and nozzle tips have been developed over the years. For example, see U.S. Pat. Nos. 4,348,170; 4,380,202; 4,479,442 and 4,634,054. All of these references have attempted to disrupt the coal roping flow into and out of the stationary coal nozzles with limited success.

In an attempt to provide better fuel distribution, other manufacturers have provided an elongated longitudinal rib down the bottom center of the nozzle. However, this configuration also has failed to provide the desired reduction in fuel roping.

It is accordingly a major object of the present invention to provide a stationary coal nozzle designed which provides more uniform fuel distribution exiting the nozzle tip into the furnace combustion zone.

SUMMARY OF THE INVENTION

The stationary coal nozzle of the present invention includes an elongated tubular nozzle having an inlet which receives a flowing stream of coal/air mixture and an outlet for discharging this flowing stream into a combustion zone of a pulverized coal fired furnace, similar to all prior art stationary coal nozzles.

The stationary coal nozzle of the present invention provides a unique distributor in the coal nozzle which consists of a plurality of transversely extending rib segments that protrude into the nozzle from its inside wall. These transversely extending rib segments are circumferentially arranged in the nozzle for distributing and diffusing a flowing stream of pulverized coal upon exiting the nozzle outlet.

In one embodiment, the rib segments constitute a first set which are positioned at a first common transverse plane within the coal nozzle and a second set of the rib segments are provided and positioned at a second common transverse plane position within the nozzle which is downstream from the first plane position, thus providing two separated sets of distributors.

The terminating portion of most stationary coal nozzles have an inside wall adjacent the outlet which is substantially rectangular in cross section with rounded corners and the inlet is generally circular to mate with connecting supply pipes. In this configuration, the distributor rib segments are positioned in the internal rounded transition corners of the coal nozzle.

These transversely extending rib segments are preferably provided with inclined longitudinally extending ramp surfaces which converge outwardly toward the nozzle inside wall in the direction of nozzle flow or in the direction from the nozzle inlet to the nozzle outlet, thereby providing a plurality of inclined longitudinally extending ramp segments with the inwardly protruding leading edges thereof facing the nozzle inlet and the trailing edges thereof facing the nozzle outlet.

Normally the first and second set of rib segments or ramp segments each include four of the rib segments or ramp segments in each set with the rib segments of the first set being longer or similar in transverse extension than that of the second set of rib segments.

An additional feature of the stationary coal nozzle of the present invention is the inclusion of a deflector plate that covers at least one fourth but less than one half of the inlet of the stationary coal nozzle. This deflector additionally assists in eliminating fuel roping.

Coal roping wear zones in both the stationary coal nozzles and in adjustable tips for such nozzles were minimized thereby greatly increasing nozzle and nozzle tip life.

Accordingly, major advantages of the stationary coal nozzle of the present invention are that localized wear at the nozzle outlet and nozzle tip caused by coal roping is greatly reduced and where adjustable nozzle tips are used, tip life is greatly increased. In addition, uniform coal distribution is provided upon exit of the nozzle tip which results in a more stable flame due to uniform fuel distribution and provides increased boiler efficiencies and further provides easier nitrogen oxide control.

The number, size and location of the distributors and the size of the anti-roping deflector provided at the nozzle inlet are determined by those of skill in the art of burner flow physical modeling and air flow data supplied for each burner unit.

BRIEF DESCRIPTION OF THE DRAWINGS

Other objects and advantages appear hereinafter in the following description and claims.

The accompanying drawings show for the purpose of illustration, without limiting the invention or the appended claims, certain practical embodiments of the present invention wherein:

DETAILED DESCRIPTION OF A PREFERRED EMBODIMENT

Figure 1:
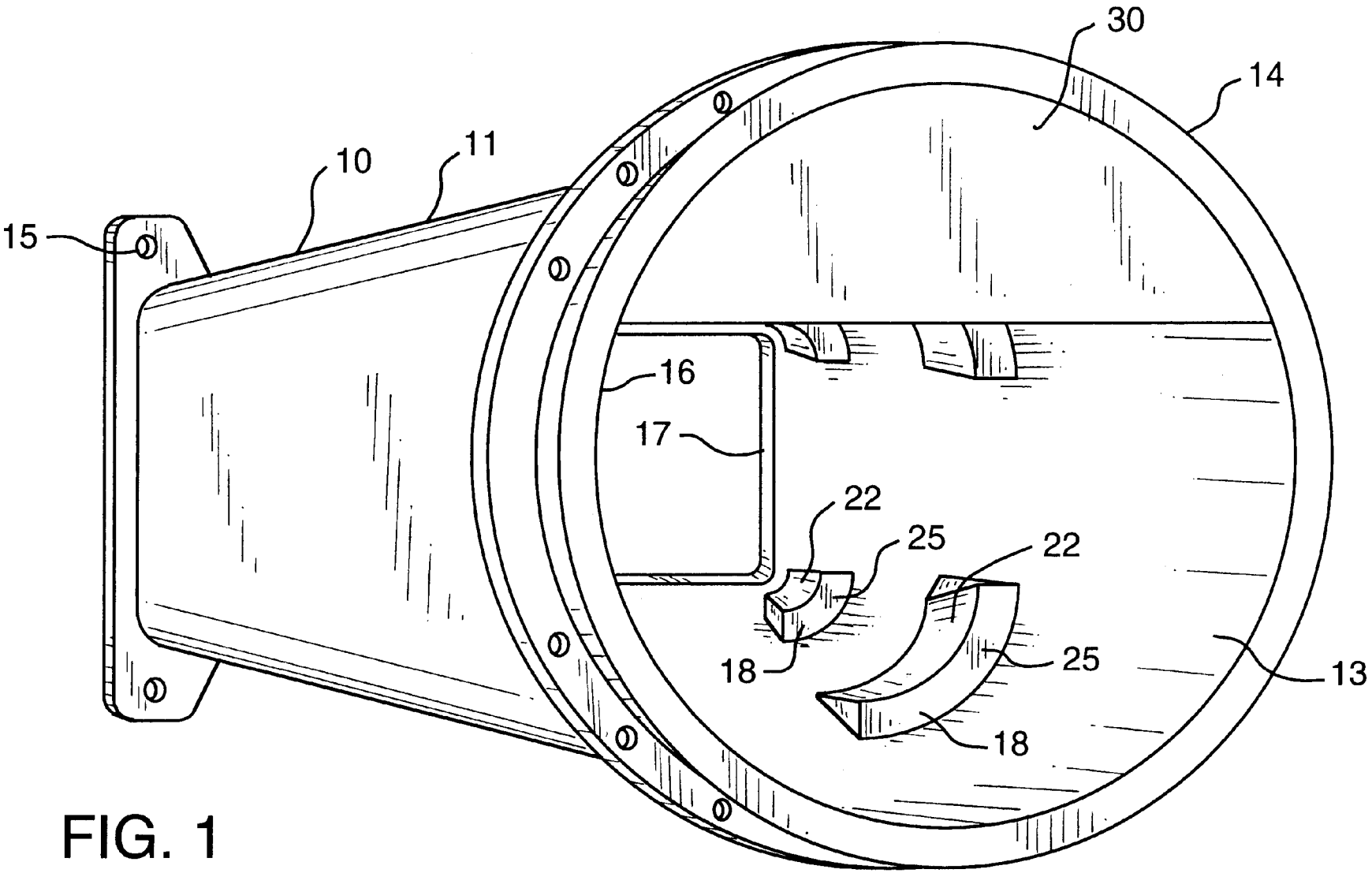
FIG. 1 is a perspective view of one embodiment of the stationary coal nozzle of the present invention with the inlet facing forward.
Figure 2:
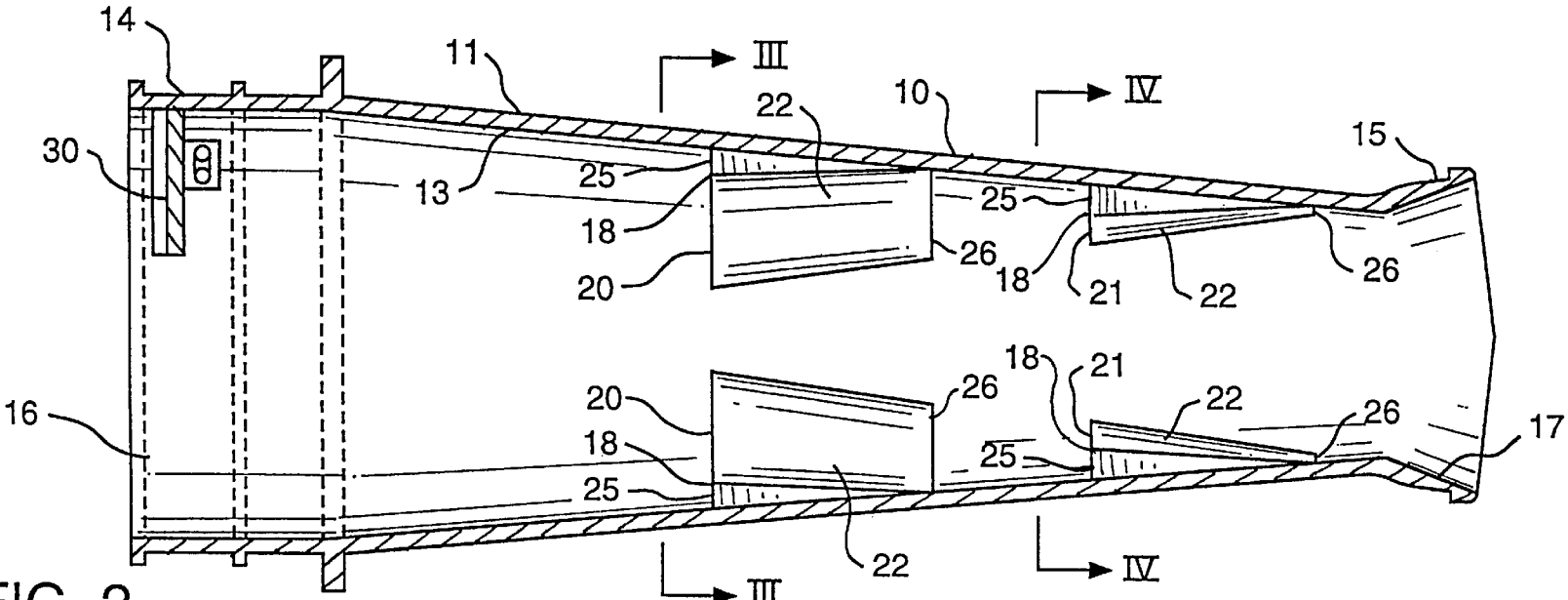
FIG. 2 is a reduced view in side elevation of the coal nozzle shown in FIG. 1 as seen in vertical mid cross section.
Figure 4:
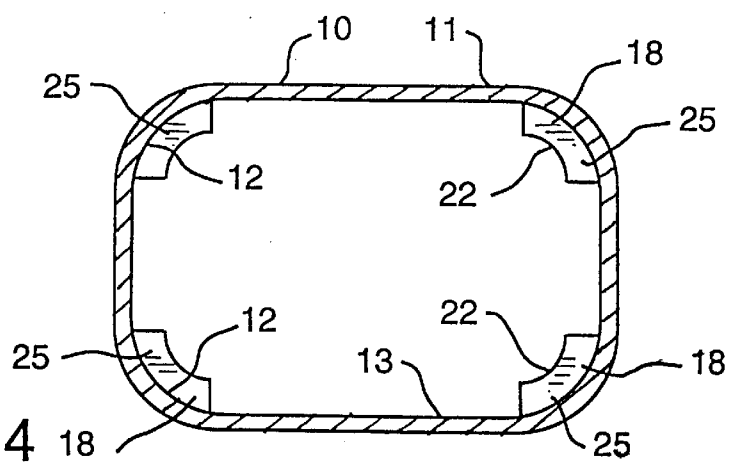
FIG. 4 is a view in vertical cross section of the coal nozzle shown in FIG. 2 as seen along section line IV—IV.
Figure 3:
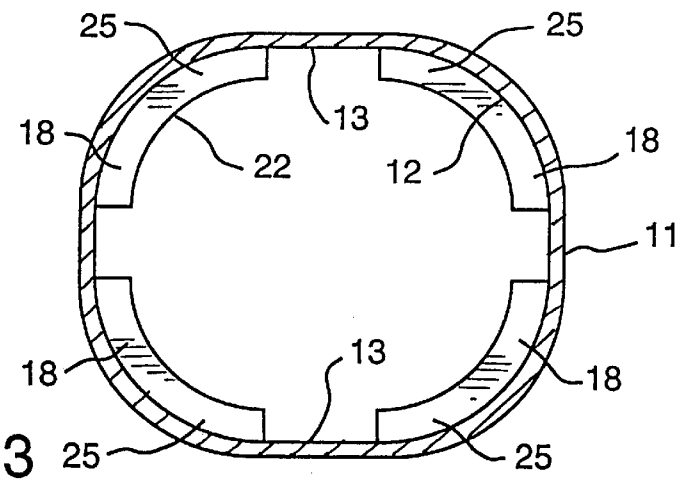
FIG. 3 is a view in vertical cross section of the fuel nozzle shown in FIG. 2 as seen along section line III—III.

Referring to the drawings, the stationary coal nozzle 10 of the present invention is generally comprised of an elongated tubular nozzle 11 having a substantially rectangular cross section with rounded corners 12 on the inside wall 13 with a circular inlet housing 14 and a flaired rectangular outlet nozzle tip 15.

The nozzle 10 is generally cast of a suitable metal.

Inlet housing 14 of nozzle 10 provides inlet 16 for receiving a flowing stream of coal/air mixture. Nozzle tip 15 provides an outlet 17 for nozzle 10 for discharging the flowing stream of coal and air into a combustion zone (not shown) of a furnace for burning. A plurality of transversely extending rib segments 18 protrude into nozzle 10 from inside wall 13 and are circumferentially arranged therein for distributing and diffusing a flowing stream of pulverized coal in the coal/air mixture upon exiting outlet 17.

Rib segments 20 constitute a first set of distributors which are positioned at a first common transverse plane or position. Rib segments 21 are positioned at a second common transverse plane position which is downstream from the first plane position of segments 20. There are four rib segments 18 in each set and they are positioned in the rounded corners 12 on the inside wall 13 of nozzle 10 and follow the contours thereof.

The rib segments 18 are each provided with an inclined longitudinally extending ramp surface 22 which converges outwardly toward nozzle inside wall 13 in the direction from inlet 16 to outlet 17.

It should be noted that the transverse extension of the first set of rib segments 20 is greater than that for the second set 21. In other words, the inclined surfaces 22 for segments 20 have a greater or larger surface area than the ramp or inclined surfaces 22 of rib segments 21.

Rib segments 18 in combination with their inclined ramp surfaces 22 provide distributors in the form of ramp segments with leading edges at 25 facing inlet 16 and trailing edges 26 thereof facing outlet 17. These circumferentially arranged distributor ramp segments 18, 22 provide effective distributing and diffusing of a flowing stream of pulverized coal (not shown) in a coal/air mixture upon exiting outlet 17.

A deflector plate 30 closes off at least one fourth but less than one half of inlet 16 and prevents roping of the pulverized fuel entering inlet 16.

Figure 5:
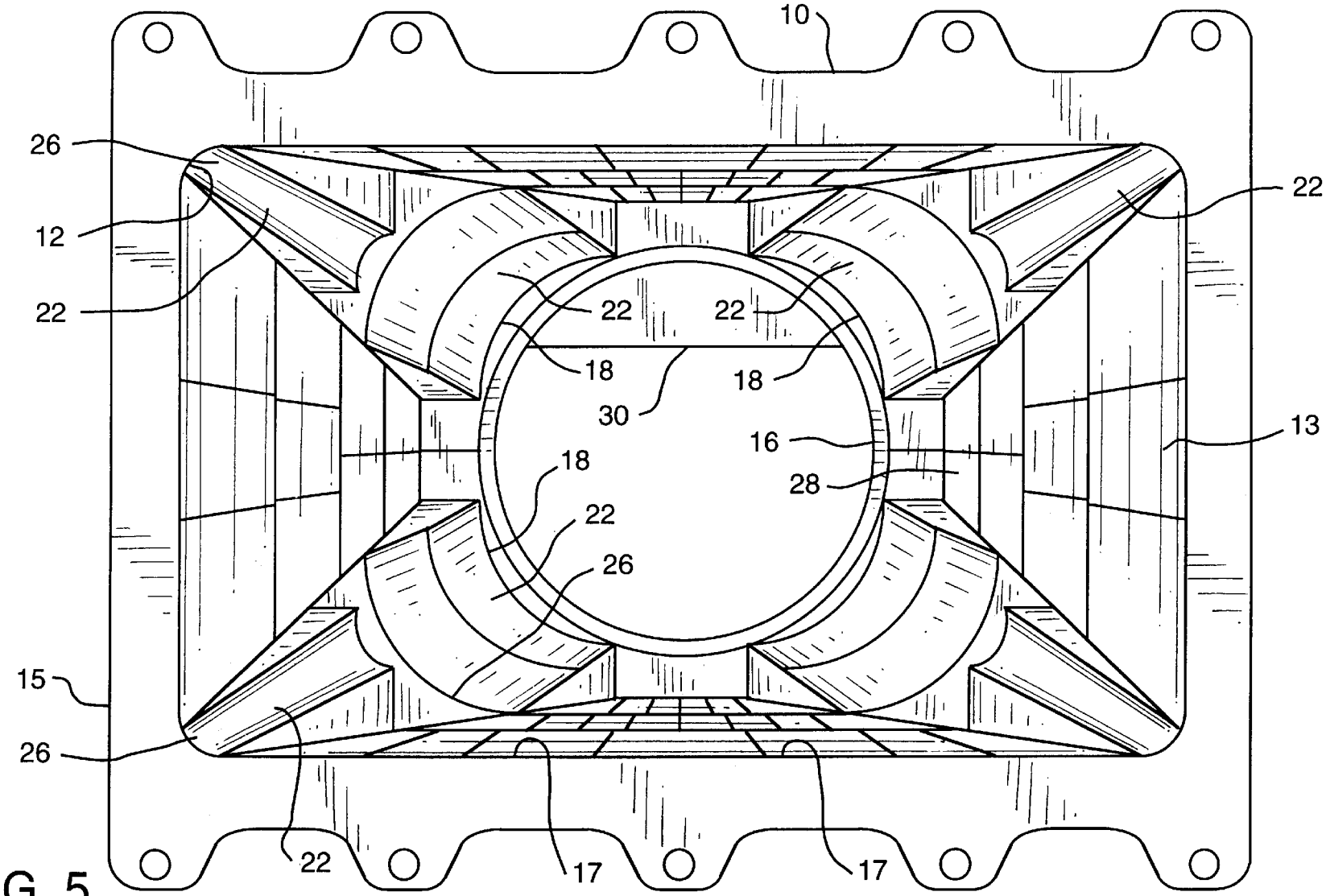
FIG. 5 is a perspective view of the outlet end of the coal nozzle shown in FIG. 1 with a ceramic lining.

As is seen in FIG. 5, which is a view into the outlet 17 of nozzle 10, the entire inside surface 13 of nozzle 10 may be lined with ceramic 28 to increase the life expectancy of the nozzle 10.

I claim:

1. A stationary coal nozzle for a burner on a pulverized coal fired furnace comprising: an elongated tubular nozzle having inside and outside walls, an inlet for receiving a flowing stream of coal/air mixture and an outlet for discharging the flowing stream into a combustion zone of a furnace for burning; a first set of four transversely extending rib segments positioned in a first common transverse plane and protruding into said nozzle from said inside wall and circumferentially arranged about said inside, wall in different quadrants for distributing and diffusing a flowing stream of pulverized coal in said mixture upon exiting said outlet.

2. The stationary coal nozzle of claim 1 including a second set of four of said rib segments positioned at a second common transverse plane position which is downstream from said first plane position.

3. The stationary coal nozzle of claim 2 wherein at least a terminating portion of said nozzle inside wall adjacent said outlet is substantially rectangular in cross section with rounded corners, said rib segments positioned in said rounded corners.

4. The stationary coal nozzle of claim 3 wherein said rib segments have inclined longitudinally extending ramp surfaces which converge outwardly toward said nozzle inside wall in the direction from said inlet to said outlet.

5. The stationary coal nozzle of claim 4 wherein said first set of rib segments are longer in transverse extension than said second set of rib segments.

6. The stationary coal nozzle of claim 5 including a deflector plate closing off an upper portion of said nozzle inlet.

7. The stationary coal nozzle of claim 1 including a deflector plate closing off an upper portion of said nozzle inlet.

8. The stationary coal nozzle of claim 7 wherein said deflector plate covers at least one fourth but less than one half of said inlet.

9. The stationary coal nozzle of claim 1 wherein said inside wall is ceramic lined.

10. A nozzle for a burner on a pulverized fuel fired furnace, including an elongated tubular nozzle having inside and outside walls, an inlet for receiving a flowing stream of coal/air mixture and an outlet for discharging the flowing stream into a combustion zone of a furnace for burning, and a fuel distributor on said inside wall for assisting in distributing and diffusing a flowing stream of pulverized coal in said mixture upon exiting said outlet; the improvement comprising said distributor including first set of four inclined longitudinally extending ramp segments positioned in a first common transverse plane with leading edges of said ramp segments facing said inlet and trailing edges of said ramp segment facing said outlet with said leading edges protruding into said nozzle from said inside wall and providing inclined segment surfaces on said ramp segments extending from said leading edges to said trailing edges, said surfaces converging outwardly toward said nozzle inside wall in the direction of said nozzle from said inlet to said outlets, said ramp segments circumferentially arranged on said inside wall in different quadrants.

11. The nozzle of claim 10 including a second set of four of said distributors circumferentially arranged on said nozzle inside wall at a second common transverse plane position which is downstream from said first plane position.

12. The nozzle of claim 10 wherein at least a terminating portion of said nozzle inside wall adjacent said outlet is substantially rectangular in cross section with rounded corners, said distributors positioned in said rounded corners.

13. The nozzle of claim 12 wherein the segment surfaces on said first set of distributors are of greater area than the segment surfaces on said second set of distributors.

14. The nozzle of claim 13 including a deflector plate closing off an upper portion of said nozzle inlet.

15. The nozzle of claim 10 including a deflector plate closing off an upper portion of said nozzle inlet.

16. The nozzle of claim 15 wherein said deflector plate covers at least one fourth but less than one half of said inlet.

17. The nozzle of claim 16 wherein said inlet is circular.

18. The nozzle of claim 10 wherein said nozzle inside wall is ceramic lined.

* * * * *